United States Patent [19]

Singer

[11] Patent Number: 4,793,045

[45] **Date of Patent: * Dec. 27, 1988**

[54] ARTICLE FORMING METHOD

[76] Inventor: Steven M. Singer, 1292 SW. Evergreen La., Palm City, Fla. 34990

[ * ] Notice: The portion of the term of this patent subsequent to Dec. 23, 2003 has been disclaimed.

[21] Appl. No.: 933,390

[22] Filed: Nov. 21, 1986

Related U.S. Application Data

[63] Continuation-in-part of Ser. No. 714,114, Mar. 20, 1985, Pat. No. 4,630,346.

[51] Int. Cl.[4] ..... B23P 5/00

[52] U.S. Cl. ..... 29/160.6; 29/10; 164/35; 164/45; 264/221; 264/225

[58] Field of Search ..... 29/10, 160.6; 164/34, 164/35, 44, 45; 264/220, 221, 225, 226, 227

[56] References Cited

U.S. PATENT DOCUMENTS 2,163,814 6/1939 Swarovski .
2,790,220 4/1957 Fox .
2,887,746 5/1959 Bogoff .
3,356,129 12/1967 Anderko et al. ..... 164/138
4,154,282 5/1979 Kull ..... 164/9
4,392,289 7/1983 Michaud ..... 29/160.6
4,421,153 12/1983 Wilkinson et al. ..... 164/35

FOREIGN PATENT DOCUMENTS 2311644 5/1975 France .

*Primary Examiner*—P. W. Echols
*Attorney, Agent, or Firm*—Leonard Bloom

[57] ABSTRACT

A method of forming a bezel that contacts and/or substantially envelops a gem without altering the same is presented. A replica of the gem is initially formed about which a temporary bezel is crafted having the desired artistic markings thereon. In a lost wax process, the temporary bezel is replaced by a permanent bezel. Then the replica is destroyed. In another aspect of the present invention, a replica mold material for use in this process is also disclosed.

8 Claims, 6 Drawing Sheets

ARTICLE FORMING METHOD

CROSS REFERENCE TO RELATED APPLICATIONS

This application is a continuation-in-part of co-pending application Ser. No. 714,114, filed March 20, 1985, now U.S. Pat. No. 4,630,346 the disclosure of which is, by reference, incorporated herein in its entirety.

FIELD OF THE INVENTION

The following method relates to a method of forming an article and materials therefor and, more specifically, to a method of making jewelry to enhance the retention of a gem in a bezel area of the jewelry, as well as a replica mold material for use therewith.

BACKGROUND OF THE INVENTION

One of the most problematic occurrences with jewelry is the dislodgement of the gem from its retaining area (bezel). Constraints have been placed upon the formation of the bezel which include the avoidance of deforming, marring or in other ways distorting the gem to be displayed which would, thereby alter its value. Due to these constraints, no suitable method has been developed for forming a bezel which grips or substantially envelops a gem, so as to prevent its dislodgment therefrom.

The state of the art, of which I am aware, may be represented by the patents listed on the Information Disclosure Statement attached hereto.

In U.S. Pat. No. 4,630,346 issued Dec. 23, 1986 which the present application is a continuation-in-part thereof, I disclosed a method for crafting a bezel which would grip or substantially envelop a gem, so as to prevent its accidental dislodgment therefrom, without deforming, marring or in any way distorting or altering the gem. In carrying out this previously disclosed method, an identical replica of the gem is formed from, primarily, "ELMER'S TM" glue, an investment compound, cornstarch and salt. Unfortunately, due to the components from which this replica is fabricated, it is not able to withstand the temperatures to which it would be exposed during the lost wax process. Rather, these temperatures result in at least a partial vaporization of the replica during the lost wax process. Consequently, the method disclosed in application No. 714,114 requires that, prior to the lost wax process, the replica be removed from a temporary support (temporary bezel) by dissolving it in water.

The process disclosed in application No. 714,114, while constituting a significant contribution to the art, nevertheless required that in two separate steps: (1) the replica be removed from the temporary support; and (2) that the temporary support be replaced by a permanent support (bezel). In addition, the materials from which the replica is fabricated can prove difficult to work with, and dry relatively slowly, thereby increasing the length of time required in forming the permanent support (bezel).

Thus, it can be seen that there exists a need for a replica mold material which dries quickly, is easy to work with and which can withstand the heat to which it is exposed during casting in the lost wax process.

SUMMARY OF THE INVENTION

Accordingly, it is the primary objective of the present invention to alleviate the disadvantages and deficiencies of the prior art by providing a replica mold material which is easy to work with, readily available, dries quickly, is durable and which can withstand the heat to which it is exposed during casting in a lost wax process without vaporizing, either partially or wholly.

It is another objective of the present invention to open up new possibilities in jewelry design and formation.

It is a further objective to provide a method for forming an article or a bezel which grips and/or substantially envelops a gem, so as to prevent its dislodgment therefrom, where, the replica is removed (destroyed) after the temporary bezel is replaced by a permanent bezel.

In accordance with the teachings of the present invention, there is disclosed herein, a method of making jewelry to enhance the retention of a gem in a retaining bezel area of the jewelry. This method includes casting a replica of the gem. A temperature sensitive substance is crafted about and against the replica to form a temporary bezel, so that the replica cannot be removed therefrom without destroying by any deformation of the temporary bezel (support) or the replica or by any shifting of the surfaces of the temporary bezel in contact with the replica either the replica or the temporary bezel area. The crafted temporary bezel is then allowed to set. Then, the retaining bezel is formed from the temporary bezel in a lost wax process having molten metal, wherein the molten metal sets and then, subsequently, the replica is destroyed.

In a preferred embodiment, the casting of the replica of the gem includes obtaining and utilizing the gem as a model initially. The gem is then casted in a molding material. The molding material is then allowed to set, whereby a molded material is formed. The molded material is divided into at least two segments to expose the gem. In this manner, a recess is provided in each of at least two divided molded material segments thus formed. The gem is then removed from the set molded material to expose the recesses. Plaster of Paris is mixed with dental investment to form a powder component. The powder component is then mixed with water to form a replica mold material. Into the recesses is casted the replica mold material. The replica mold material is then allowed to set. The replica mold material is then removed from the recesses of the molded material, whereby a replica is casted. In a preferred embodiment, the powder component and water can be mixed so as to form a replica mold material having a batter-like consistency.

In further accordance with the teachings of the present invention, there is also disclosed a method of making jewelry to enhance the retention of a gem in a retaining bezel area of the jewelry. This method includes obtaining and utilizing the gem as a model initially. The gem is casted in a molding material. The molding material is allowed to set, whereby a molded material is formed. The set molded material is divided to expose the gem, thereby providing a recess in at least two divided molded material segments thus formed. The gem is then removed from the set molded material to expose the recesses. Into the recesses is casted a material which is soluble in the presence of a fluid and which further is substantially heat impervious, so that it will not be destroyed by heating during the lost wax process. The recesses are then aligned so that when set, the cast material has the external configuration of the gem. The cast material is then allowed to set. The cast material is then removed from the recesses of the molded material. A temperature sensitive but fluid impervious substance is crafted about and against the cast material to form the bezel area for the gem. In this manner, the cast material cannot be removed therefrom without destroying either the cast material or the said crafted bezel area. The temperature sensitive substance is then allowed to set. The temperature sensitive substance is then vaporized using a lost wax process having molten material, then, the cast material is subsequently dissolved in the presence of a fluid using the lost wax process. The molten material is allowed to set during the lost wax process, prior to dissolving of the cast material. The set molten material is then polished. Finally, the gem is placed into the bezel area of the set molten material, whereby retention of the gem is enhanced.

In another aspect of the present invention, there is disclosed a method of casting to improve interfit between one component and its associated cast support. This method includes obtaining and utilizing the one component as a model initially. The one component is casted in a molding material. The molding material is then allowed to set, whereby a molded material is formed. The set molded material is divided to expose the one component. The one component is then removed from the set molded material to expose recesses, whereby at least two separate segments are formed having recesses formed therein. Into the recesses is casted a material which is soluble in the presence of a fluid and which further is substantially heat impervious, so that it will not be destroyed by heating during the lost wax process. The recesses are then aligned so that the cast material has an external configuration of the one component when set. The cast material is permitted to set. The cast material is then removed from the recesses of the molded material. A temperature sensitive, fluid impervious substance is crafted about and against the cast material to form the support area for the one component so that the cast material cannot be removed therefrom without destroying either the cast material or the said crafted support area. The temperature sensitive substance is allowed to set. The temperature sensitive substance is then vaporized using a lost wax process having molten material. The cast material is then dissolved in the presence of a fluid. The molten material is allowed to set during the lost wax process prior to dissolving of the cast material. The set molten material is then polished. Finally, the one component is placed into the support area of the set molten material, whereby retention of the one component is enhanced.

In further accordance with the teachings of the present invention, there is disclosed a method of making jewelry having a bezel area to retain a stone therein, including, in combination, casting a molding material about the entire exterior surface of the stone. The casted molding material is allowed to set, whereby a molded material is formed. The set, casted molded material is then separated into at least two separate segments to expose the stone. The stone is then removed from the set, casted molded material, whereby at least two separate segments are formed having recesses therein being of such a shape that when aligned said recesses are substantially identical to the configuration of the stone. A soluble and substantially heat impervious material is casted in each respective recess of the separated segments. The recesses of the separated segments are then aligned having the soluble material therein. The casted soluble material is then allowed to set, forming a soluble, substantially heat impervious replica of the stone having a substantially identical coincidence as the external configuration of the stone. The set soluble, substantially heat impervious replica is removed from the separate segments. A substantially liquid, temperature sensitive but fluid impervious wax is fashioned about and adhering to the replica (such as, for example, when the wax grips and/or substantially envelops the replica of the gem), so that the replica cannot be removed therefrom without either the replica or the fashioned wax being destroyed. The wax is then allowed to set. The wax is then crafted and marked with decorative patterns desired to be exhibited on the jewelry having the bezel area. The temperature sensitive wax is then vaporized using a lost wax process having a molten metal, whereby the molten metal replaces the wax. The replica is subsequently dissolved in a liquid. Finally, the molten material sets during the lost wax process prior to the dissolving of the replica, whereby the jewelry having a bezel area to retain a stone therein, is formed.

In still further accordance with the teachings of the present invention there is disclosed a method of making jewelry having a bezel to retain a gem therein, including, in combination, forming a replica of the gem. Said replica has an external configuration being substantially identical to the external configuration of the gem. A temporary wax gem bezel having an artistic design thereon is crafted about the replica. Said bezel adheres substantially to the external configuration of the replica so that said replica cannot be physically removed from the temporary bezel without substantially destroying the artistic design thereon or without destroying the replica. A permanent bezel of cast metal having the artistic design thereon is formed from the temporary bezel by a lost wax process. The replica is destroyed in situ subsequent to the lost wax process without affecting the artistic design of the setting of the permanent bezel. Finally, the gem is installed in the cast metal fitting with a minimum of adjustments thereto, whereby the gem is securely held.

In another aspect of the present invention, there is disclosed a material for molding a replica comprised of plaster of Paris, dental investment and water. Preferably, this material is comprised of approximately four parts plaster of Paris, approximately one part of dental investment (which has been utilized in the jewelry casting art for some years and which is well known to those skilled in the art), and water. The water being provided is in a quantity, so that when fixed with the plaster of Paris and the dental investment, has a batter-like consistency.

DESCRIPTION OF THE PREFERRED EMBODIMENTS

Figure 1:
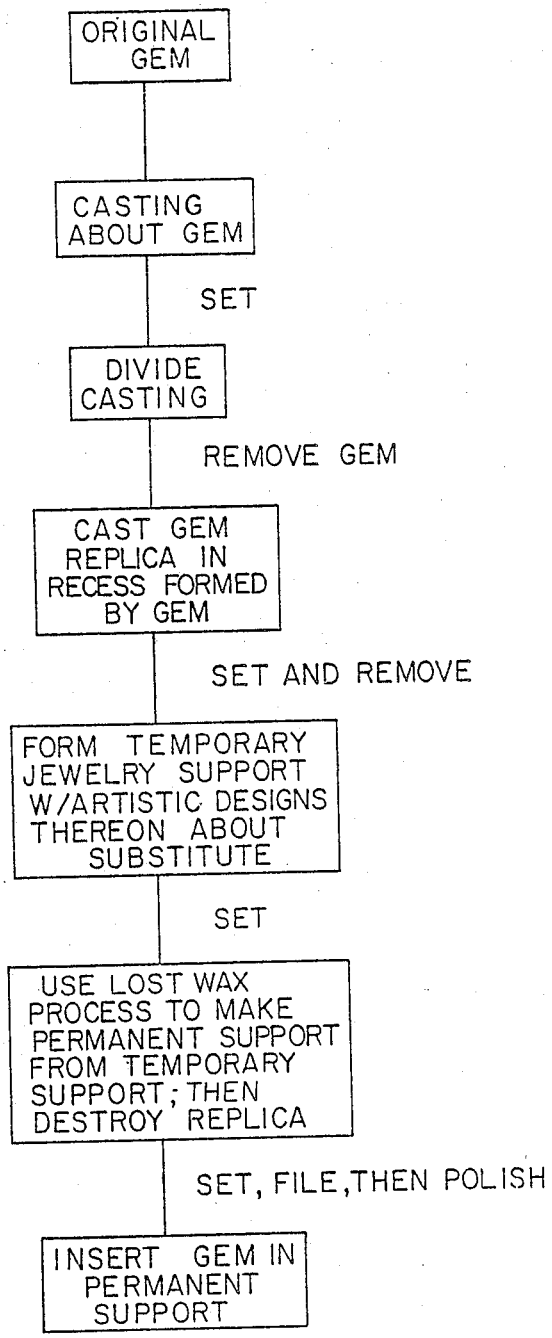
FIG. 1 is a block diagram of the process of the present invention.

With reference now to the drawings, the replica mold material shall be described in the context of the article forming method of the present invention. In FIG. 1, there is shown a block diagram representation of the method for forming the article. In FIGS. 2–29 there is a pictorial rendition thereof.

Figure 2:
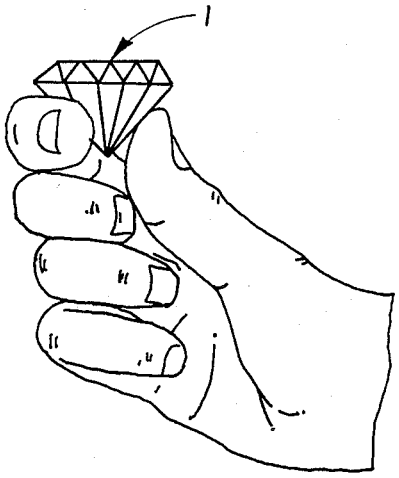
FIG. 2 illustrates selection of the one component to be mounted.
Figure 3:
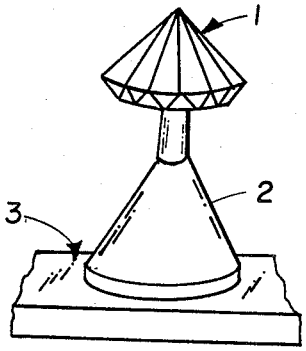
FIG. 3 illustrates the one component removably mounted on a sprue base of the molding frame removed therefrom for the sake of clarity.
Figure 4:
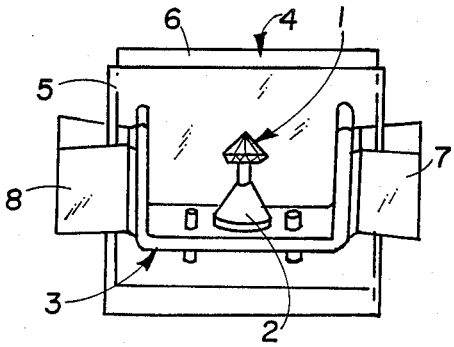
FIG. 4 is the assembled molding box having the gem removably mounted on the sprue base thereof.

Initially, a one component (a gem, stone, jewel or the like) 1 to be mounted is chosen and obtained (FIG. 2). This component is also utilized initially as a model of which a replica is to be fabricated. The gem 1 is removably mounted on a sprue base 2 that is part of a molding frame 3 (FIG. 3). A molding box 4 is then assembled by placing walls 5 and 6 about the molding frame 3 which carries the sprue base 2, and then securing said walls 5 and 6 in place by use of clamps 7 and 8 (FIG. 4).

Figure 5:
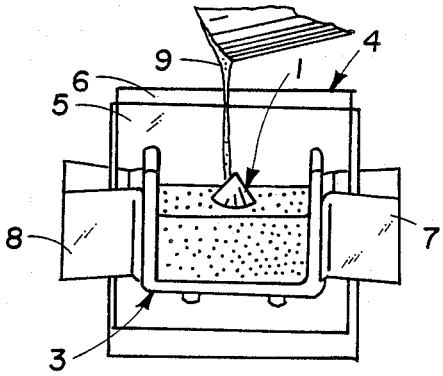
FIG. 5 illustrates molding material being poured into the molding box.

Once the molding box 4 is assembled as aforesaid, casting of the removably mounted gem 1 in a molding material 9 is then commenced by pouring any suitable liquid molding material 9 into the frame 3 of the box 4 (FIG. 5). Preferably, the molding material 9 used is of the type which becomes transparent when set. Casting then is continued by heating the molding material 9 for, preferably, half an hour at 350° F.

Figure 6:
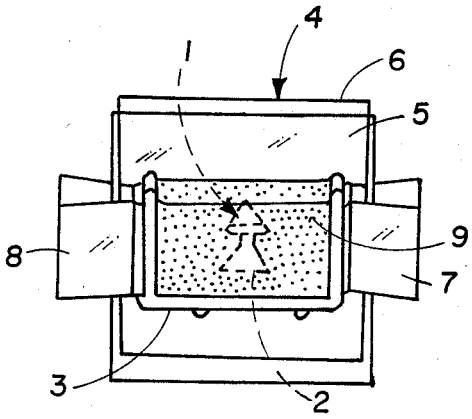
FIG. 6 is the casted, cooled molding material in the molding box with the positioning of the sprue base and the gem therein shown in broken lines for the sake of clarity.
Figure 7:
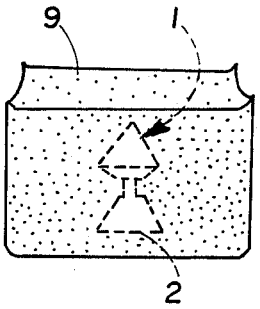
FIG. 7 is the now molded material as it is removed from the molding box and frame with the positioning of the gem and the void formed by the sprue base therein shown in broken lines for the sake of clarity.

Next, the heated molding material 9 is permitted to cool and to set, wherein said molding material 9 turns substantially clear (FIG. 6). The molding box 4, including the frame 3 and the sprue base 2 are then removed from the set molded material 9 leaving a block of the molded material 9 having a gem 1 embedded therein (FIG. 7).

Figure 8:
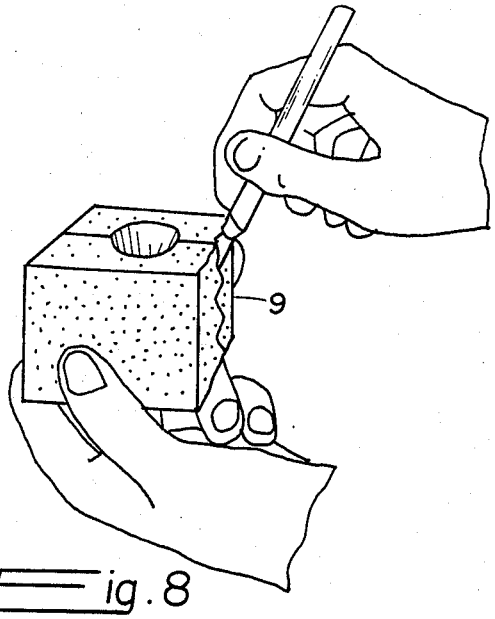
FIG. 8 illustrates the artisan performing the preferred incision in the molded material in which the gem is positioned, so as to divide the material into two segments.
Figure 9:
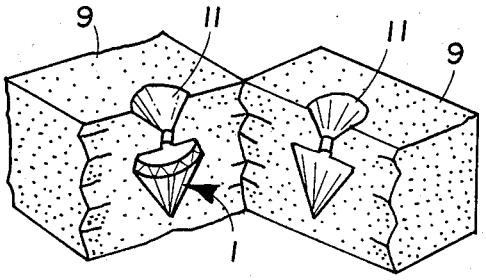
FIG. 9 illustrates the segments of the molded material separated from one another exposing the gem which is carried in the recess of one of the segments and also exposing the recess in the other segment.
Figure 10:
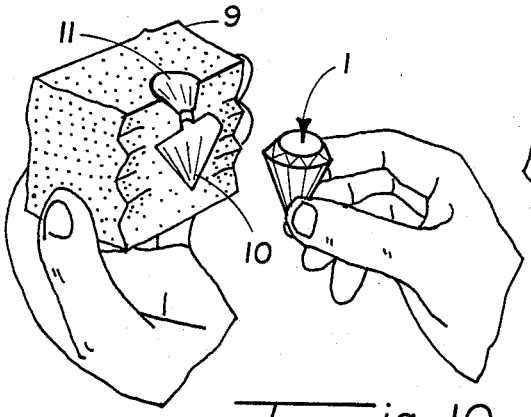
FIG. 10 illustrates the artisan removing the ge from the recess of one segment of the molded material exposing the recess formed therein.

The artisan next makes an incision with a scalpel, or is equivalent, in the now casted and set molded material 9. As seen in FIG. 8, this incision is preferably made in a zig-zag pattern of short alternating intersecting incisions. The said material 9 is then divided into at least two segments to expose the gem 1 (FIG. 9). Typically, the mold material 9 is cut into two sections along an axis of symmetry of the gem 1 so that upon dividing, a recess will be exposed in one segment and in the other segment the gem 1 will be exposed (FIG. 9), so that it may be easily extricated from the molded material 9 by hand (FIG. 10).

Figure 11:
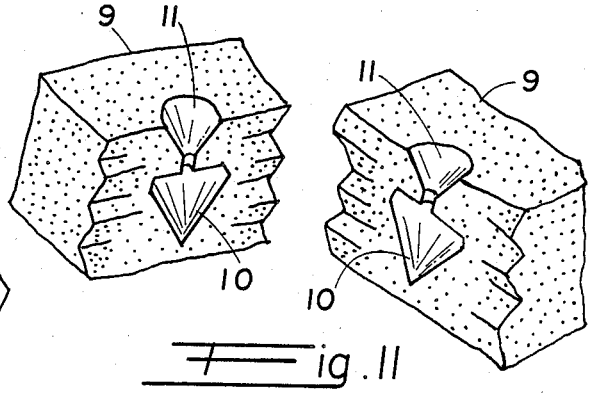
FIG. 11 illustrates the recesses formed in each segment within the molded material.

Removal of the gem 1 from the set molded material 9 reveals (exposes) a recess 10 formed in each segment within the molded material 9 (FIG. 11). The void 11 left in the molded material 9 by the sprue base is also exposed. If the two segments are placed together, the recesses 10 will have a contour corresponding identically to the outer surface of the gem 1. It is contemplated that depending upon the contour of the gem 11, the recess 10 may reside either fully or substantially in one of the segments of the mold material when separated. In this event, the entire mold cavity is found in one segment. Alternatively, the gem can be removed by cutting the molded material so that a plurality of segments are provided, the totality of which, when assembled, defines the recess within which the gem 1 was cast. In any event, it is essential that the gem 1 be removed in such a way that the dimensions of said gem 1 be reflected with absolute fidelity by the totality of the recesses.

Figure 12:
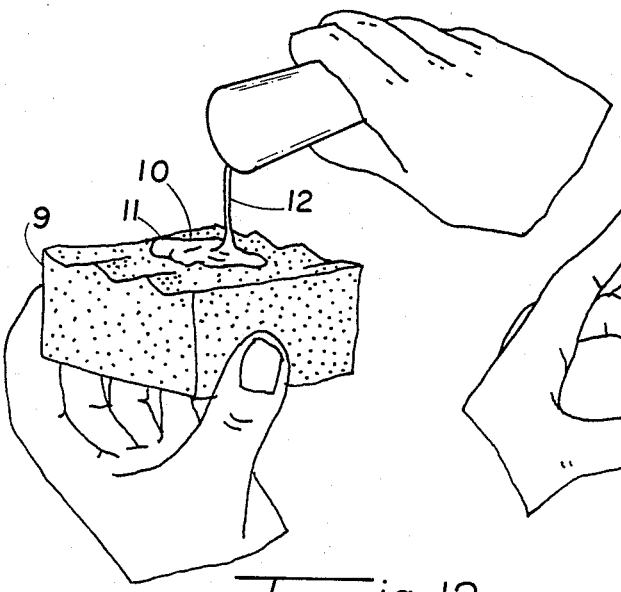
FIG. 12 illustrates the artisan pouring the replica mold material to be cast into one of the recesses.
Figure 13:
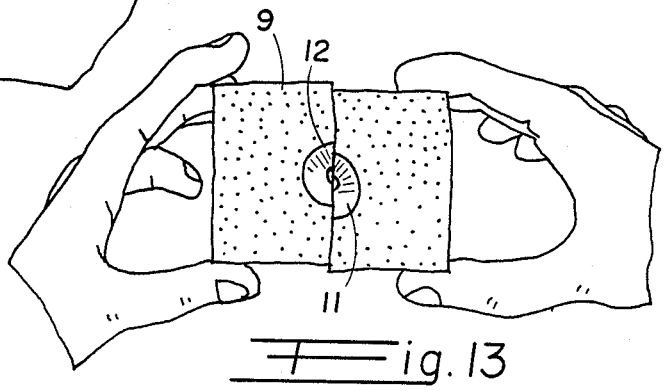
FIG. 13 illustrates the artisan aligning the recesses within each segment with one another.

Next, a water soluble and substantially heat impervious replica mold material 12 is then cast in each of the recesses 10 (FIG. 12). The recesses are then aligned and secured together (FIG. 13) so that when set, the replica mold material 12 will have the external configuration of the gem 1. In this respect, it will be appreciated by those skilled in the art that the zig-zag incision made in the molded material by the artisan, as described earlier, aids in the artisan performing the most accurate alignment possible. In this respect, the void 11 left in the molded material 9 by the sprue base (as described earlier) also aids in obtaining an accurate alignment.

Preferably, the replica mold material 12 is comprised of four parts plaster of Paris and one part dental investment. This dental investment is that which has been utilized in the jewelry casting for some years and which is well known to those skilled in the art. First, the plaster of Paris and the dental investment are mixed to form a powder component. Then this powder component is mixed with water until the material 12 has a batter-like consistency. It is to be understood however, that the ratio of four parts plaster of Paris to one part dental investment is flexible and that a variance of this ratio will still yield an appropriate replica mold material 12. It is to be further understood that, consonant with the teachings of the present invention, other components may also be added to the material. The ratio of four parts plaster of Paris to one part dental investment is nonetheless preferred in that it dries fast and yields a durable model which can withstand the temperatures involved in the lost wax process without either partially or wholly melting or vaporizing.

The replica mold material 12 is then allowed to set, whereby it hardens. It is the recesses 10 within the molded material 9 that provides the contour which the replica mold material 12 fills when poured and the contour which the replica mold material 12 adopts when it hardens. Thus, upon hardening, the replica mold material 12 has a total correspondence to the external configuration of the gem 1.

Figure 14:
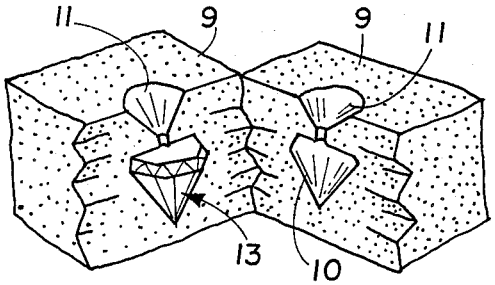
FIG. 14 illustrates the segments of the molded material separated to expose the molded replica (cast material).
Figure 15:
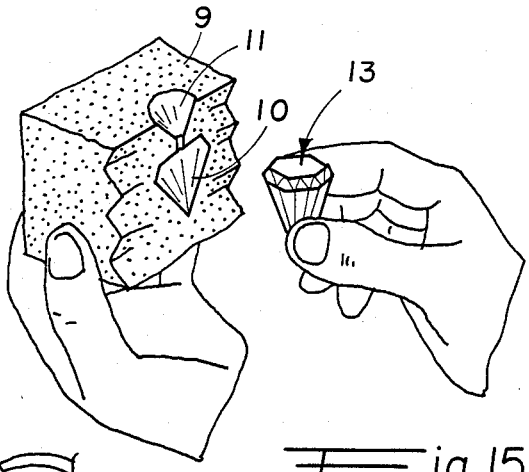
FIG 15 illustrates the artisan manually removing the replica (cast material) from the segments of the molded material.
Figure 16:
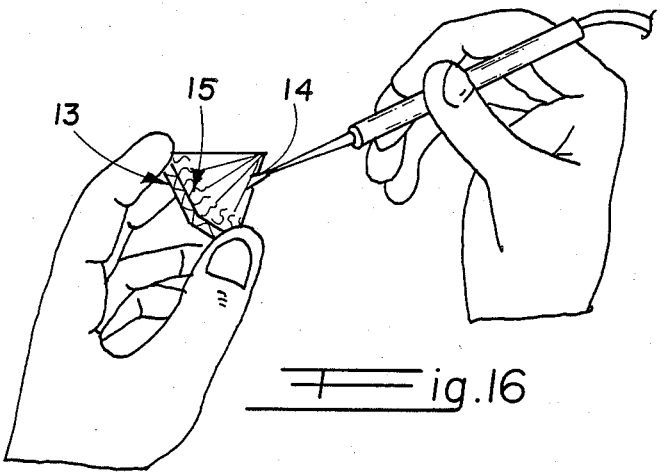
FIG. 16 illustrates the artisan crafting the temporary bezel about and against the replica.

Once the replica mold material 12 has set, the two segments of mold material 9 are reseparated, exposing the replica (the cast material) 13 (FIG. 14). The now exposed replica 13 may then be manually removed from the recesses 10 of the molded material 9 for further use (FIG. 15).

Next, a temperature sensitive (but fluid impervious) substance (wax) 14 is crafted about and against the replica 13 to form the temporary bezel (temporary support) 15 for the gem 1 (FIG. 16), so that the replica 13 cannot be removed therefrom without destroying either the replica 13 or the said crafted temporary bezel (support) 15 or the artistic designs to be crafted thereon by the artisan by any deformation of the temporary bezel (support) or the replica or by any shifting of the wax surfaces in the contact with the replica. The replica 13 serves as a model upon which an artisan works the wax 14 of the temporary bezel 15 along the desired faces of the replica 13 and crafts in the wax 14 the artistic designs and decorative patterns which are desired to be exhibited on the permanent bezel, so that the temporary bezel 15 thus formed corresponds to the configuration and style desired for the permanent bezel. While the bezel to be formed can be of any style, this method is expressly useful in cases wherein the permanent bezel desired to be formed grips and/or substantially envelops the gem 1.

Figure 17:
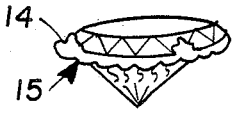
FIG. 17 is the crafted temporary bezel and the associated replica.

Once the artistic working of the temporary bezel 15 is completed and the desired artistic designs are crafted thereon, the temperature sensitive substance (the wax) 14 is then permitted to set, wherein said wax 14 cools and hardens (FIG. 17).

Next, using a lost wax process having a molten metal, the temporary bezel is replaced with a permanent bezel of molten metal. Then the replica is dissolved.

Figure 18:
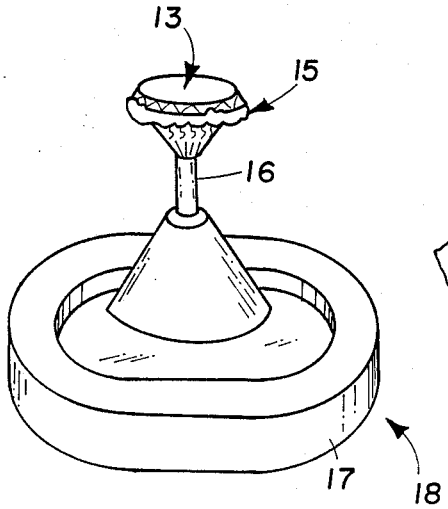
FIG. 18 shows the temporary bezel and replica mounted on the sprue of the lost wax process casting chamber.
Figure 19:
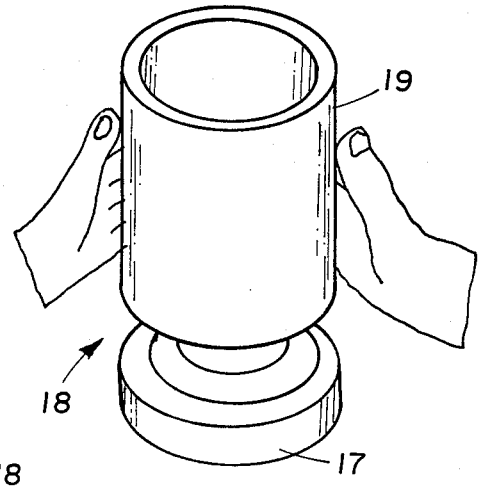
FIG. 19 illustrates the artisan assembling the remainder of the lost wax casting chamber.
Figure 20:
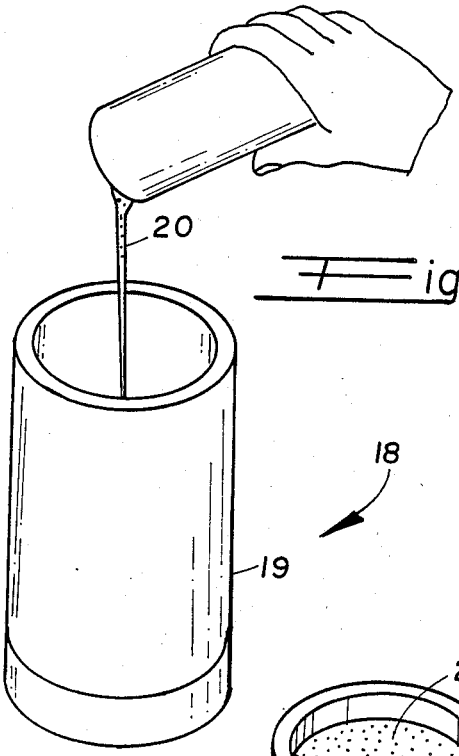
FIG. 20 illustrates the artisan filling the lost wax casting chamber with casting material.
Figure 21:
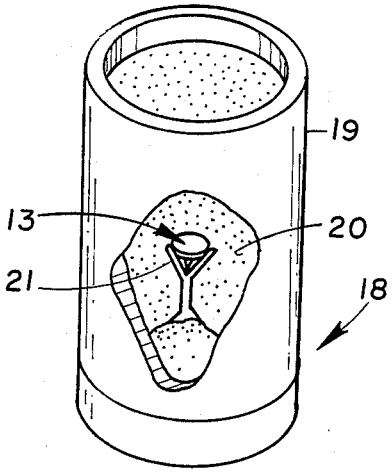
FIG. 21 illustrates the lost wax casting chamber being partially broken away to reveal the replica and the void formed by vaporization of the temporary bezel in the casting material during the lost wax process.
Figure 22:
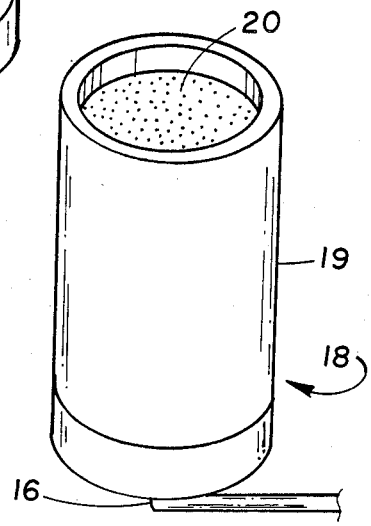
FIG. 22 illustrates molten metal being injected through the sprue into the void formed by vaporization of the temporary bezel.
Figure 23:
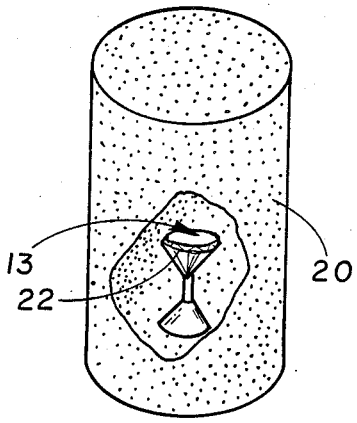
FIG. 23 illustrates the block of casting material partially broken away to show the permanent support and the replica therein.

In lost wax casting, the temporary bezel 15 desired to be replaced by a permanent bezel is positioned on a sprue of wax 16 which is carried by a wall 17 of the casting chamber (flask) 18 (FIG. 18). Once mounted on said sprue, the wall 17 is secured to a metal jacket 19 whereby the chamber 18 is assembled (FIG. 19). Said chamber 18 is then filled with a casting material 20 (FIG. 20). The casting material 20 then is permitted to set. Once set, the chamber 18 is heated for a required number of hours at a temperature of approximately 1,000° F. This heating results in the temperature sensitive wax vaporizing, leaving a void 21 in the casting material 20 within the flask 18 which corresponds identically with the shape and design of the now vaporized temporary bezel (FIG. 21). However, due to its heat impervious qualities, the replica mold material remains substantially unaffected by the heating that occurs during lost wax casting. The molten metal is then introduced (injected) into the flask 18 via the sprue 16, wherein it fills the void (cavities) left by the now vaporized wax (FIG. 22) and wherein the molten metal sets. Thus, the wax forming the crafted temporary bezel is replaced by the metal of the permanent bezel, so that the permanent bezel corresponds identically to the crafted configuration of the temporary bezel which is designed to grip or substantially envelop the gem.

Figure 24:
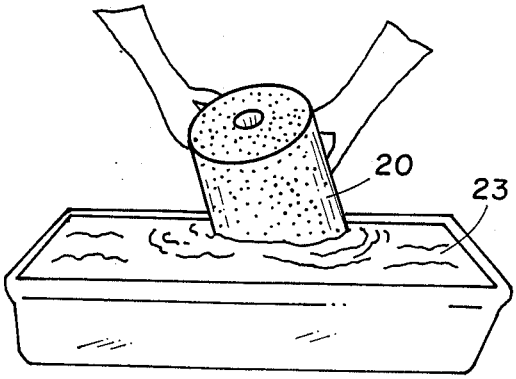
FIG. 24 illustrates the artisan immersing the block of casting material in water.
Figure 25:
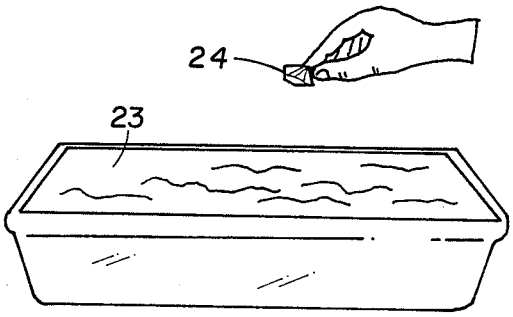
FIG. 25 illustrates the artisan removing the permanent bezel from the water.
Figure 26:
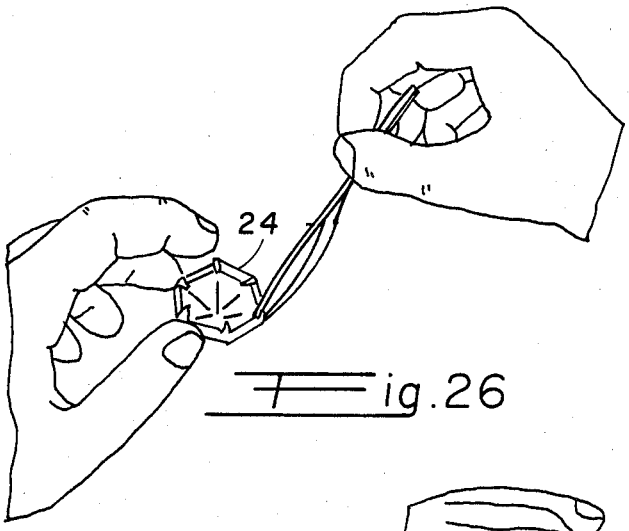
FIG. 26 illustrates the artisan opening the permanent bezel within its plastic limits.

Next, the chamber (flask) is then dismantled and the block casting material 20 located therein, which has the replica 13 and the set molten metal 22 embedded therein (FIG. 23), is removed therefrom. The entire block of casting material 20 is then placed in water 23 as part of the lost wax process (FIG. 24). Placement of the support block 19 in water as part of this process not only cools the now casted material 22, but also serves to destroy (dissolve) the block of casting material 19 as well as the replica embedded therein. Once the molten material has been cooled and set and the casting material and the replica have been dissolved, the artisan merely needs to manually remove the permanent bezel 24 having the artistic design thereon from the water 23 (FIG. 25).

Figure 27:
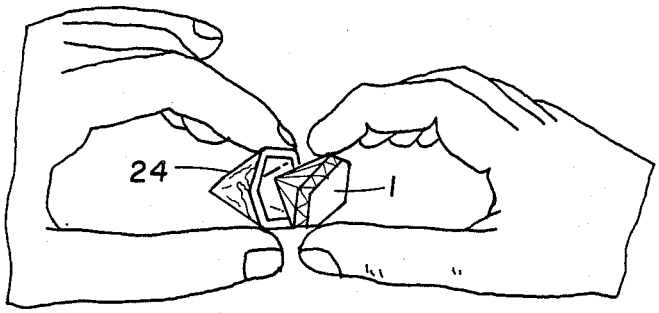
FIG. 27 illustrates the artisan placing the gem within the bezel.
Figure 28:
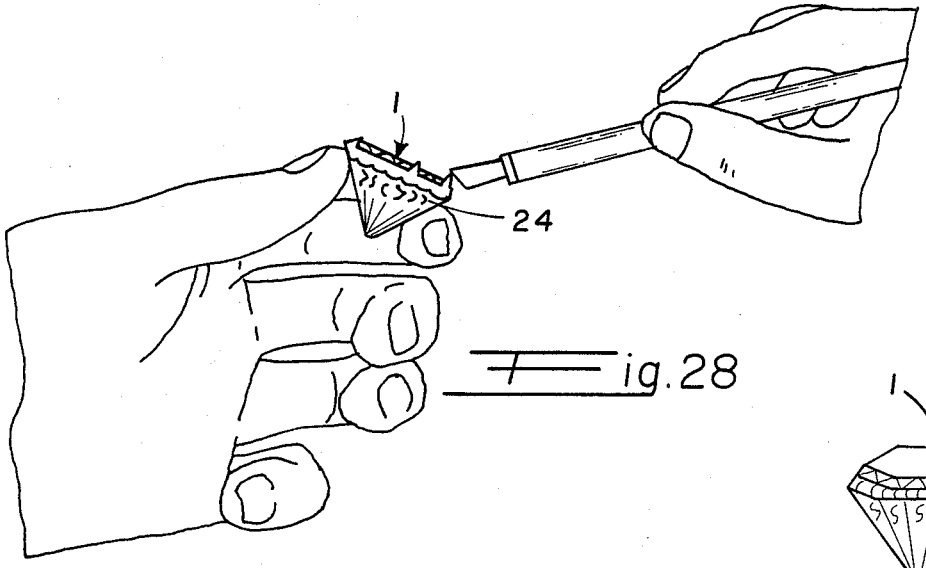
FIG. 28 illustrates the artisan returning the support area of the bezel, having the gem positioned therein, to substantially its original configuration.
Figure 29:
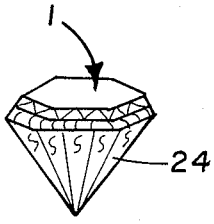
FIG. 29 shows the completed permanent bezel, having the artistic designs thereon.

Once removed from the water, the artisan may further craft, mark and/or polish the permanent bezel as desired. Once the bezel 24 has been completely crafted as desired, the support area of the bezel 24 is then opened up by being plastically deformed (FIG. 26), thereby permitting the gem 1 to be placed into the said support area of the permanent bezel 24 (FIG. 27). Upon the completion of such placement, the bezel 24 is then returned to its original configuration (FIG. 28), whereby the permanent bezel 24 grips and at least partially envelops the gem 1, enhancing retention thereof (FIG. 29).

From the foregoing, it can be seen that described above is an improved mold material which dries quickly, is easy to work with and which is soluble while being substantially impervious to the heat to which it is subjected during the lost wax process. It can further be seen that, described above is an improved process wherein, in the lost wax process, first the temporary support is replaced by a permanent support and then the replica is subsequently destroyed.

In view of the foregoing, it is apparent that while a specific example with respect to jewelry has been delineated, the method associated herewith is equally compatible in other casting environments, for example dentistry, in which a component is required to be adapted to be placed in intimate tangential contact with a support structure to assure that the component and its area of interconnection with the support structure is one in which the areas of tangency exist as intended. The technique according to the instant application insures that air gaps, pockets and variations in the contour of the coterminous faces will not exist, but rather, will be of the highest order of quality so that the objects associated with the instant application can be realized.

Having thus described the invention, it should be apparent that numerous structural modifications are contemplated as being part of this invention as set forth hereinabove and as defined hereinbelow by the claims.

What is claimed is:

1. A method of making jewelry to enhance the retention of a gem in a retaining bezel area of the jewelry comprising the steps of:
   casting a replica of the gem using a soluble casting material that is substantially resistant to heat;
   crafting a temperature sensitive substance about and against the replica to form a temporary bezel which encloses sides of the gem, so that the replica cannot be removed therefrom without destroying either the replica or the temporary bezel;
   allowing the crafted temporary bezel to set;
   forming the retaining bezel from the temporary bezel in a lost wax process having molten metal, using a soluble casting material as a support block for the temporary bezel, wherein the molten metal sets to form the retaining bezel; and
   dissolving the replica and casting material leaving the retaining bezel.

2. The method of claim 1, wherein casting a replica of the gem is comprised of the steps of:
   obtaining and utilizing the gem as a model initially;
   casting the gem in a molding material;
   allowing the molding material to set, whereby a molded material is formed;
   dividing the molded material into at least two segments to expose the gem, thereby providing a recess in each of at least two divided molded material segments thus formed;
   removing the gem from the set molded material to expose the recesses;
   mixing plaster of Paris with dental investment to form a powder component;
   mixing the powder component with water to form a replica mold material;
   casting into the recesses the replica mold material;
   allowing the replica mold material to set; and
   removing the replica mold material from the recesses of the molded material, whereby a replica is casted.

3. The method of claim 2, wherein the powder component and water are mixed to form a replica mold material having a batter-like consistency.

4. The method of claim 1, further comprised of the steps of:
   polishing the set molten material; and
   placing the gem into the bezel of the set molten material, whereby retention of the gem is enhanced.

5. A method of making jewelry to enhance the retention of a gem in a retaining bezel of the jewelry, comprising the steps of:
   obtaining and utilizing the gem as a model initially;
   casting the gem in a molding material;
   allowing the molding material to set, whereby a molded material is formed;
   dividing the set molded material to expose the gem, thereby providing a recess in at least two divided molded material segments thus formed;
   removing the gem from the set molded material to expose the recesses;
   casting into the recesses a material which is substantially resistant to heat and further which is soluble in the presence of a fluid, and aligning the recesses so that when set, the cast material has the external configuration of the gem and is a replica thereof;
   allowing the replica cast material to set;
   removing the replica cast material from the recesses of the molded material;
   crafting a temperature sensitive but fluid impervious substance about and against the replica cast material to form a temporary bezel for the gem, so that the replica cast material cannot be removed therefrom without destroying either the replica cast material or the said crafted temporary bezel;
   allowing the temperature sensitive substance to set;
   adding a casting material as a support block about the temporary bezel which is substantially resistant to heat and further which is soluble in the presence of a fluid;
   vaporizing the temperature sensitive substance using a lost wax process having molten material, wherein the molten material sets to form the retaining bezel for the gem;
   dissolving the cast material in the presence of a fluid;
   polishing the set molten material; and
   placing the gem into the bezel area of the set molten material, whereby retention of the gem is enhanced.

6. A method of casting to improve interfit between one component and its associated cast support including the steps of:
   obtaining and utilizing the one component as a model initially;
   casting the one component in a molding material;
   allowing the molding material to set, whereby a molded material is formed;
   dividing the set molded material to expose the one component;
   removing the one component from the set molded material to expose recesses, whereby at least two separate segments are formed having recesses formed therein;
   casting into the recesses a material which is substantially resistant to heat and further which is soluble in the presence of a fluid, and aligning the recesses so that the cast material has an external configuration of the one component when set;
   allowing the cast material to set;
   removing the cast material from the recesses of the molded material;
   crafting a temperature sensitive, fluid impervious substance about and against the cast material to form a crafted support area for the one component, so that the cast material cannot be removed therefrom without destroying either the cast material or the said crafted support area;
   allowing the temperature sensitive substance to set;
   vaporizing the temperature sensitive substance using a lost wax process having molten material, wherein the molten material sets to form a support area for receiving the one component;
   dissolving the cast material in the presence of a fluid to leave the support area for receiving the one component;
   polishing the set molten material; and
   placing the one component into the support area of the set molten material, whereby retention of the one component is enhanced.

7. A method of making jewelry having a bezel area to retain a stone therein, comprising, in combination, the steps of:

casting a molding material about the entire exterior surface of the stone;

allowing the casted molding material to set, whereby a molded material is formed;

separating the set, casted molded material into at least two separate segments to expose the stone;

removing the stone from the set, casted molded material, whereby at least two separate segments are formed having recesses therein being of such a shape that when aligned said recesses are substantially identical to the configuration of the stone;

casting a soluble, substantially heat resistant material in each respective recess of the separated segments;

aligning the recesses of the separated segments having the soluble material therein;

allowing the casted soluble material to set, forming a soluble replica of the stone having a substantially identical coincidence as the external configuration of the stone;

removing the set heat resistant soluble replica from the separate segments;

fashioning a substantially liquid, temperature sensitive but fluid impervious wax about and adhering to the replica, so that the replica cannot be removed therefrom without being destroyed;

allowing the wax to set;

crafting and marking the wax with decorative patterns desired to be exhibited on the bezel area of the jewelry;

adding a casting material as a support for the wax which is substantially resistant to heat and which is also soluble in the presence of a liquid;

vaporizing the temperature sensitive wax using a lost wax process having a molten metal, whereby the molten metal replaces the wax;

allowing the molten material to set, whereby the jewelry having a bezel area to retain a stone therein is formed; and dissolving the replica and the casting material in a liquid.

8. A method of making jewelry having a bezel to retain a gem therein, comprising, in combination, the steps of:

forming a soluble, substantially heat resistant replica of the gem, said replica having an external configuration being substantially identical to the external configuration of the gem;

crafting a temporary wax gem bezel having an artistic design thereon about the replica, said bezel adhering substantially to the external configuration of the replica so that said replica cannot be physically removed from the temporary bezel without substantially destroying the artistic design thereon or without destroying the replica;

forming a permanent bezel of cast metal having the artistic design thereon from the temporary bezel by a lost wax process;

destroying the replica in situ by dissolving in a liquid without affecting the artistic design of the setting of the permanent bezel; and installing the gem in the cast metal fitting with a minimum of adjustments thereto, whereby the gem is securely held.

* * * * *